United States Patent [19]

Yoshizawa

[11] Patent Number: 4,782,956

[45] Date of Patent: Nov. 8, 1988

[54] MAGNETIC TAPE CASSETTE WRAPPER

[75] Inventor: Keiichi Yoshizawa, Chiba, Japan

[73] Assignee: TDK Electronics Co., Ltd., Tokyo, Japan

[21] Appl. No.: 460,703

[22] Filed: Jan. 24, 1983

[30] Foreign Application Priority Data

Jul. 12, 1982 [JP] Japan ..... 57-104391
Aug. 6, 1982 [JP] Japan ..... 57-118906

[51] Int. Cl.[4] ..... B43M 7/00

[52] U.S. Cl. ..... 206/606; 206/623; 206/497

[58] Field of Search ..... 206/604, 605, 606, 254, 206/615, 628, 497, 623; 229/87 C

[56] References Cited

U.S. PATENT DOCUMENTS

| | | | |
|---|---|---|---|
| 1,961,560 | 6/1934 | Herrmann | 206/606 X |
| 2,002,564 | 5/1935 | Bergman | 206/604 X |
| 2,295,231 | 9/1942 | Milmoe | 229/87 C |
| 2,324,017 | 7/1943 | Neumair | 206/628 X |
| 3,001,644 | 9/1961 | Fourness | 206/606 X |
| 3,144,194 | 8/1964 | Cartwright | 206/628 |
| 3,568,910 | 3/1971 | McConnell | 229/17 R |

*Primary Examiner*—Henry J. Recla
*Assistant Examiner*—David Voorhees
*Attorney, Agent, or Firm*—Seidel, Gonda, Lavorgna & Monaco

[57] ABSTRACT

A magnetic tape cassette in a case overwrapped with a plastic film having a tear tape wound on all four sides of the case close to, and substantially in parallel with, one case end, the film being overlapped at the mating edge portions and glued together on a side of the case adjoining to the above end, with the tear tape extended between the overlapped edge portions, is characterized in that at least one cut is made in the overlying one of the edge portions, extending along the edge of the tear tape closer to one case end and, where an additional cut is provided, the latter extending obliquely away from the end of the opposite edge of the tear tape. The underside of the end portion of the tear tape and, when desired, the same side of the overlying film edge portion, are made adhesive-repellent. The end portion of the tear tape may extend beyond the overlying film edge portion.

16 Claims, 3 Drawing Sheets

MAGNETIC TAPE CASSETTE WRAPPER

This invention relates to a magnetic tape cassette, and more specifically to an overwrap for the cassette case.

Magnetic tape cassettes are marketed in cases with a skintight overwrap of cellophane or shrinkable polypropylene sheet or film. The coherent wrapper extends the shelf life of magnetic tape cassettes as well as other varieties of merchandise. In addition, with a design or mark printed, the film can make the packages more attractive and salable. Since the film is difficult to tear off the case when the cassette is to be used, it has been customary that the overwrap has a tear tape attached as an opening aid. One example is illustrated in FIGS. 1 and 2. A piece of wrapping film 1 covers the whole surface of a case 2 containing a cassette. At a short distance from, and in parallel with, one end of the case, a thin tear tape 3 is extended between the outer surface of the case 2 and the inner surface of the wrapping film 1. The tear tape, usually glued to the inner surface of the overwrap, protrudes at one end to provide a tab 4. Along the both edges of the tear tape, and adjacent to the tab 4, the wrapping film 1 routinely has a pair of cuts 5, 6 of a given length. The cuts enable the tear tape to be easily torn away as the tab 4 is pulled out, from the cuts onward in the direction of the chain lines. Pulling off the tape around all four sides of the case leaves the overwrap severed into two, and the smaller part A can be readily removed by hand. In the case of a package whose contents can be taken out of the end so uncovered, the other wrapping part B may be left intact to provide good outward appearance as well as protection for the contents. With a magnetic tape cassette package, the film part B too must be stripped off before the cassette is used. If the overwrap is made of cellophane, the low strength would make it relatively easy to tear the film away. However, the cellophane film is so sensitive to moisture that it can readily crease to mar the appearance. For this reason it has recently been supplanted to a large measure by a shrinkable film of polypropylene or other plastics. The latter has, however, a drawback because of its greater strength; the overwrap part B, left behind by the tear tape removal, can hardly be broken by a finger tip, and removing that part is often troublesome.

The present invention is aimed at solving the aforedescribed problems of the prior art and providing an overwrap for a magnetic tape cassette case which can be easily stripped off.

The invention will be better understood by the following description when taken in conjunction with the accompanying drawings showing embodiments thereof. In the drawings.

Figure 1:
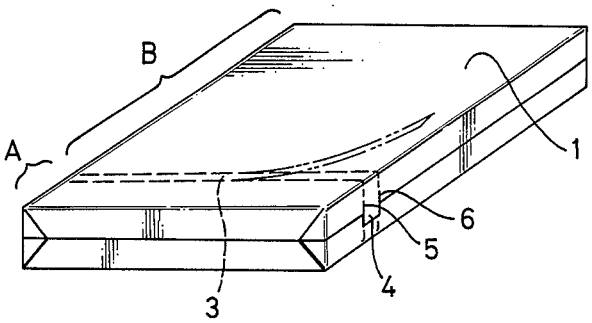
FIG. 1 is a perspective view of a conventional magnetic tape cassette with an overwrap on its case.
Figure 2:
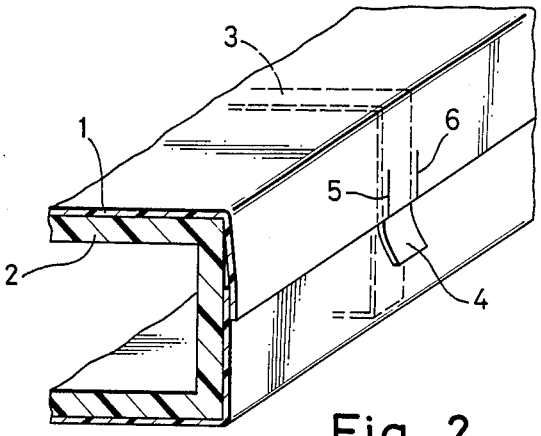
FIG. 2 is a perspective view of a fragment of FIG. 1 on an enlarged scale.
Figure 3:
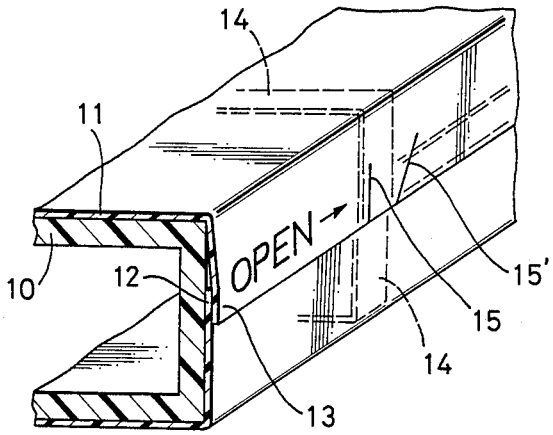
FIG. 3 is an enlarged fragmentary view in perspective of a first embodiment of the overwrapped magnetic tape cassette according to the invention.
Figure 4:
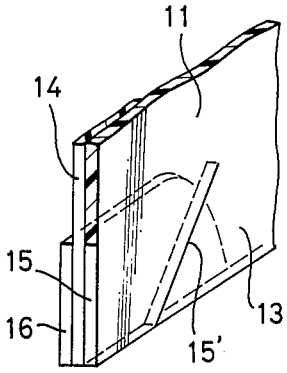
FIG. 4 is an enlarged perspective view of a fragment of the embodiment, showing a tear tape and cuts.
Figure 5:
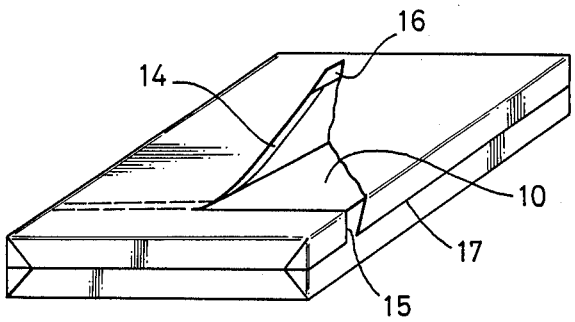
FIG. 5 is a perspective view of the first embodiment, illustrating how to tear open the overwrap.

Referring now to the drawings, specifically to FIG. 3, there is shown a fragment of a cassette packaged with an overwrap incorporating a first embodiment of the invention for tearing the wrap open. The numeral 10 designates a cassette case and 11, an overwrap of shrinkable polypropylene film or the like applied over the case 10. The film covers the case and overlaps at edges 12, 13 along the horizontal centerline of one side of the case, the edge portions being united by an adhesive layer 17 (FIG. 5). As shown in FIGS. 3 and 5, a tear tape 14 of plastics is inserted between the case 10 and the overwrap 11, at a short distance from, and generally in parallel with, one end of the case. The tear tape 14 is held in place by being at least partly glued to the inner surface of the overwrap. It extends at one end to the horizontal edge 13 of the overwrap, where there is a cut 15 of a given length made perpendicularly to the overwrap edge and aligned to the left edge of the tear tape (as viewed from the right side). The cut is deep enough to reach the underlying tear tape. It must be made along the edge of the tear tape closer to the end of the case in the vicinity of which the tape is applied. Another cut 15' extends athwart, upwardly from the point of the overwrap edge 13 in agreement with the right edge end of the tear tape. As FIG. 4 shows, either an inner surface portion of the tear tape 14 or a slightly larger inner surface portion of the overwrap edge 13 has an appropriately adhesive-repellent layer. This layer is originally necessary to keep the portion nonadhesive while the edges 12, 13 of the wrapping film are joined together at the time of packaging. The overwrap is marked, as in FIG. 3, with letters "OPEN" and an arrow indicating the portion to be torn first.

With the construction described, the cassette package is opened in the manner now to be explained. Following the instruction "OPEN", a finger tip or the like is applied with pressure between the cuts 15 and 15'. The particular edge portion 13, nonadhesive because of the adhesive-repellent layer 16, is easily raised away from the rest. As this tab-like portion is pulled out by fingers, the outerwrap is torn along the left edge of the tear tape 14. At the same time, the overwrap tears progressively from the cut 15= obliquely upward so that, as illustrated in FIG. 5, a major part of the overwrap is stripped off. As described, the overwrap on a cassette tape case according to the invention can be readily torn open with the aid of the two cuts made in the upper one of overlapped edge portions of the wrapping film on one side of the case, one cut 15 extending a short distance perpendicularly from the overwrap edge and along the left edge of the tear tape (or the edge of the tape usually closer to the end of the taped case portion), and the other cut 15' extending obliquely upward from the wrapping film edge to the major part of the overwrap.

Figure 6:
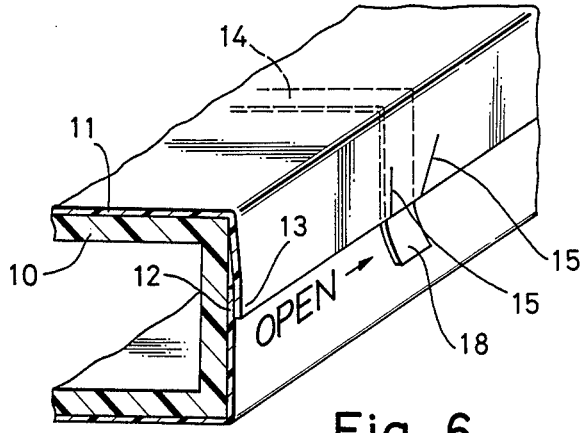
FIG. 6 is an enlarged fragmentary view in perspective of another embodiment of the invention.

FIG. 6 shows another embodiment of the invention, wherein parts like or similar to those in FIGS. 3 to 5 are designated by like numerals and the description is omitted. This embodiment differs from the first in that the tear tape is extended a short length beyond the overlying edge of the overlapped wrapping film edges, thus forming a tab 18 to be pulled out by fingers. This embodiment may or may not have an adhesive-repellant layer. With this package again, a pull of the tab 18 will easily tear the overwrap open, in the same manner as illustrated in FIG. 5.

Figure 7:
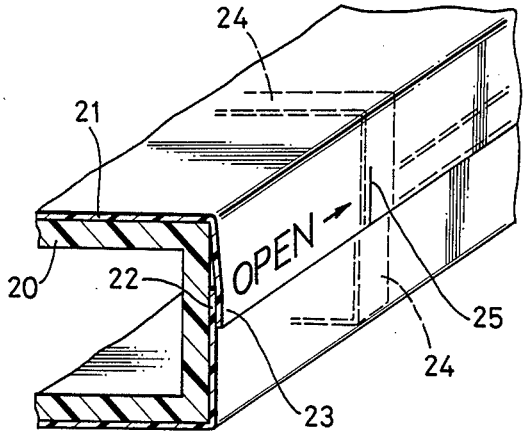
FIG. 7 is a view similar to FIG. 6 but showing still another embodiment.
Figure 8:
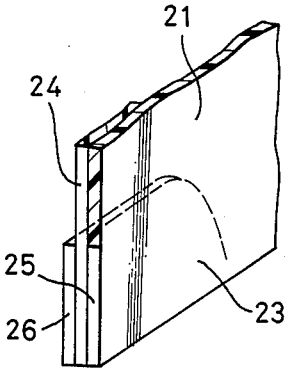
FIG. 8 is a view similar to FIG. 4 but showing a single cut instead of two, besides a tear tape.
Figure 9:
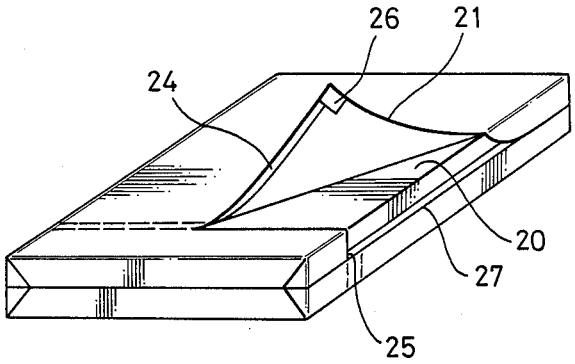
FIG. 9 is a perspective view of the third embodiment, illustrating how to open the overwrap.

FIGS. 7 to 9 show still another embodiment of the cassette packaged with means for tearing the overwrap off the case in accordance with the invention. Throughout the figures, 20 is a cassette case and 21 is an overwrap of shrinkable polypropylene film or the like on the case. The wrapping film 21 covers the case 20 and overlaps at both edges 22, 23 along the horizontal centerline of one side of the case, the edge portions being united by an adhesive layer 27. As better shown in FIGS. 7 and 9, a tear tape 24 of plastics is inserted between the case 20 and the overwrap 21, at a short distance from, and in parallel with, one end of the case. The tear tape is held in place by being at least partly glued to the inner surface of the overwrap 21. One end of the tear tape extends to the overlying edge 23 of the overwrap, where the edge portion has a cut 25 of a given length and a depth enough to reach the tape. The cut is perpendicular to the overwrap edge and aligned to the left edge of the tear tape 24 (as viewed from the right side). It is essential that the cut be made along the edge of the tear tape closer to the end of the case in the vicinity of the tear tape. As shown in FIG. 8, either an inner surface portion of the tear tape 24 or a slightly larger inner surface portion of the overwrap edge 23 has an appropriately adhesive-repellant layer. This layer is originally needed to keep that portion nonadhesive while the edges 22, 23 of the wrapping film are joined together for packaging. As FIG. 7 shows, the overwrap is marked "OPEN" with an arrow indicating the portion to be torn first.

The cassette package with the overwrap described above is uwrapped in the following way. As indicated by the mark "OPEN", a finger nail or the like is applied on the cut 25, and the cut portion is depressed sideways as directed by the arrow. The limited edge portion 23, nonadhesive with the adhesive-repellent layer 26, is easily raised away from the rest. As this tab-like portion is pulled out by fingers, the overwrap is torn along the left edge of the tear tape 24. Simultaneously, the overlying edge portion is broken away from the underlying portion 22 along the upper edge of the adhesive layer 27, so that a major part of the overwrap 21 is torn off, as indicated in FIG. 9. Thus, in this embodiment the overwrap on the cassette tape case can be readily torn open with the aid of the single cut made in the upper one of the overlapped film edge portions on one side of the case, extending a short distance perpendicularly from the overwrap edge along the left edge of the tear tape (generally on the side of the tape closer to the end of the tear-taped case portion). An additional advantage is that, in the course of packaging cassette cases, only a single cutter blade is needed in making the cut after the overwrapping of each case.

Figure 10:
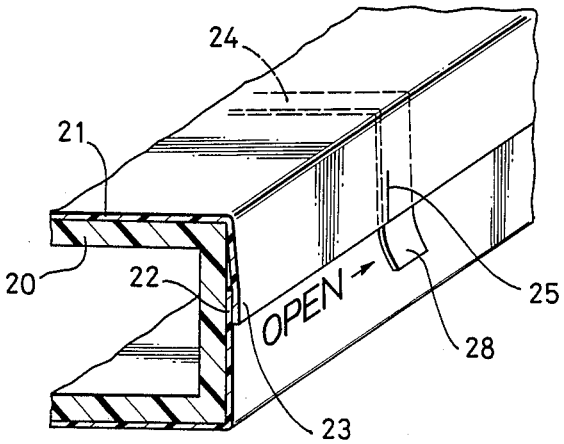
FIG. 10 is an enlarged fragmentary view in perspective of yet another embodiment.

FIG. 10 illustrates yet another embodiment of the invention, wherein the parts like or similar to those in FIGS. 7 to 9 are designated by like numerals and the description is omitted. It differs from the preceding embodiment in that one end of the tear tape is extended beyond the overlying edge of the overwrap to provide an exposed tab 28. An adhesive repellant layer on the underside of the tab is preferred but not essential. As is the case with the embodiment shown in FIG. 9, a pull of the tab will easily lead to unwrapping of the package.

While preferred embodiments of the invention have been described, it will be obvious to those skilled in the art that various changes and modifications may be made within the spirit and scope of the invention.

What is claimed is:

1. A magnetic tape cassette in a case overwrapped tightly with a plastic film having a tear tape wound on all four sides of the case close to, and substantially in parallel with, one case end, said film being overlapped at the mating edge portions and glued together on a side of the case adjoining said one case end, with said tear tape extended between the overlapped edge portions, characterized in that two cuts are made in the overlying one of the edge portions, one cut extending along the edge of said tear tape closer to said one case end and the other cut extending obliquely away from the opposite edge of said tear tape.

2. A magnetic tape cassette according to claim 1, in which the underside of the end portion of said tear tape is made adhesive-repellent.

3. A magnetic tape cassette in a case wound on all four sides with a tear tape close to, and substantially in parallel with, one case end and overwrapped tightly with a plastic film, said film being overlapped at edge portions and united with separable adhesive on a side of the case adjoining said one case end, with said tear tape extended between the edge portions, characterized in that a single cut is made in the overlying one of the edge portions so as to extend along the edge of said tear tape closer to said one case end.

4. A magnetic tape casette according to claim 3, in which the underside of the end portion of said tear tape is made adhesive-repellent.

5. A magnetic tape cassette according to claim 3, in which both the underside of the end portion of said tear tape and that of the overlying film edge portion adjacent the cut and on the side of the cut opposite the one case end are coated with an adhesive-repellent agent.

6. A magnetic tape cassette in accordance with claim 1 in which the end portion of said tear tape extends beyond the upper one of the overlapping edges of said overwrap.

7. A magnetic tape cassette in accordance with claim 2 in which the end portion of said tear tape extends beyond the upper one of the overlapping edges of said overwrap.

8. A magnetic tape cassette in accordance with claim 3 in which the end portion of said tear tape extends beyond the upper one of the overlapping edges of said overwrap.

9. A magnetic tape cassette in accordance with claim 4 in which the end portion of said tear tape extends beyond the upper one of the overlapping edges of said overwrap.

10. A magnetic tape cassette according to claim 1, in which the tear tape is adhered to the underside of the overwrap so that the portion of the overwrap overlying the case end opposite the one case end is removed with the tear tape.

11. A magnetic tape cassette according to claim 3, in which the tear tape is adhered to the underside of the overwrap so that the portion of the overwrap overlying the case end opposite the one case end is removed with the tear tape.

12. A package overwrapped with a plastic film having a tear tape wound on all four sides of the package close to, and substantially in parallel with, one package end, said film being overlapped at mating edge portions and glued together on a side of the package adjoining said one package end, with said tear tape extended between the overlapped edge portions, characterized in that two cuts are made in the overlying one of the edge portions, one cut extending along the edge of said tear tape closer to said one package end, and the other cut extending obliquely away from the opposite edge of said tear tape.

13. A package according to claim 12, in which the under side of the overlying film edge portion between the two cuts is coated with an adhesive-repellent agent.

14. A package according to claim 12, in which the end portion of said tear tape extends beyond the upper one of the overlapping edges of said overwrap.

15. A package according to claim 13, in which the end portion of said tear tape extends beyond the upper one of the overlapping edges of said overwrap.

16. A package according to claim 12, in which the tear tape is adhered to the underside of the overwrap so that the portion of the overwrap overlying the package end opposite the one package end is removed with the tear tape.

* * * * *